US006940420B2

(12) United States Patent
Jenkins

(10) Patent No.: US 6,940,420 B2
(45) Date of Patent: Sep. 6, 2005

(54) DRILL STRING TELEMETRY SYSTEM

(75) Inventor: Charles Roderick Jenkins, Willingham (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 307 days.

(21) Appl. No.: 10/318,756

(22) Filed: Dec. 13, 2002

(65) Prior Publication Data

US 2003/0179101 A1 Sep. 25, 2003

(30) Foreign Application Priority Data

Dec. 18, 2001 (GB) ..... 0130291
Jan. 24, 2002 (GB) ..... 0201535

(51) Int. Cl.[7] ..... G01V 1/00

(52) U.S. Cl. ..... 340/855.6; 340/855.4; 367/82

(58) Field of Search ..... 340/854.4, 855.6, 340/854.3; 702/6; 175/40; 166/254.2, 66; 367/82

(56) References Cited

U.S. PATENT DOCUMENTS 4,066,995 A 1/1978 Matthews
5,128,901 A 7/1992 Drumheller
5,274,606 A * 12/1993 Drumheller et al. ..... 367/82

FOREIGN PATENT DOCUMENTS

| | | |
|---|---|---|
| EP | 0 900 918 A2 | 7/1998 |
| GB | 2 327 957 A | 8/1997 |
| GB | 2 357 527 B | 12/1999 |

OTHER PUBLICATIONS

Drumheller et al The propagation of sound waves in drill strings J. Acoust. Soc., vol. 97 (4), Apr. 1995, pp. 2116–2125.

* cited by examiner

*Primary Examiner*—Michael Horabik
*Assistant Examiner*—Hung Q Dang
(74) *Attorney, Agent, or Firm*—William L. Wang; William B. Batzer; Dale Gaudier

(57) ABSTRACT

A drill string telemetry system comprises an acoustic reflector mounted to the surface end of the drill string. The reflector is adapted to reflect surface-generated torsional acoustic noise away from the drill string. The reflector attenuates the power of 500 Hz torsional acoustic noise power impinging on the reflector by a factor of at least 2.

18 Claims, 5 Drawing Sheets

DRILL STRING TELEMETRY SYSTEM

FIELD OF THE INVENTION

The present invention relates to the field of telemetry in hydrocarbon wells. In particular, the invention relates to a drill string telemetry system, an acoustic reflector for such a system, and a method of shielding a drill string telemetry system.

BACKGROUND OF THE INVENTION

Communication between down hole sensors and the surface has long been practiced in the hydrocarbon recovery industry. Long-range data signal transmission is, for example, an integral part of techniques such as Measurement-While-Drilling (MWD) and Logging-While-Drilling (LWD). Data signals have been transmitted via various carriers such as electromagnetic radiation transmitted through the ground formation, electrical transmission transmitted through an insulated conductor, pressure pulses propagated through the drilling mud, and acoustic waves propagated through the metal drill string. Each of these methods is associated with varying degrees of signal attenuation and ambient noise. There are also difficulties associated with high operating temperatures and compatibility with standard drilling procedures.

The most commercially successful of these methods has been transmission of information by pressure pulses in the drilling mud. However, attenuation mechanisms in the mud limit the effective transmission rate to less than 10 bits/sec for useful depths and mud types, though higher rates have been achieved in laboratory tests. Additionally, conventional mud pulse telemetry fails during drilling with highly compressible fluids such as gassified muds and foams. These fluids are finding an increasing market in underbalanced drilling, but reliably maintaining under-balance requires real-time monitoring of down hole annular pressure and hence high data transmission rates.

An alternative is to use axial or torsional waves propagated in the drill string as a means of carrying data. Drumeller and Knudsen (D. S. Drumheller and S. D. Knudsen, *J. Acoust. Soc.,* Vol. 97(4), April 1995, 2116–2125) provide a useful discussion of the propagation of elastic waves in drill strings, and GB-A-2357527 discusses an apparatus for creating an acoustic wave signal in a well bore.

Due to the periodic structure of the drill string, which is typically formed from approximately 9.5 m lengths of drill pipe, wave transmission in certain frequency ranges (known as stop bands) is suppressed. This leaves distinct frequency ranges (known as pass bands) that can be employed for data communication, although there is also fine structure within the pass bands. Suitable carrier frequencies for torsional waves will probably be in the first pass band, which for standard drill pipes is around 250 Hz. However frequencies in the base band (around 0–140 Hz), or the second pass band (around 350–400 Hz), may also be suitable, depending on noise levels, attenuation and transmitter powers.

An important consideration for the realisation of practical acoustic drill string telemetry systems is the suppression of acoustic noise in the drill string so that at the acoustic receiver a high signal-to-noise ratio (i.e. the ratio of the power of the signal to the power of the noise) and hence high data transmission rates can be achieved.

For example, GB-A-2327957 discloses a noise isolating section which is introduced in the drill string e.g. to insulate an MWD sensor or transmitter from acoustic noise generated by the drill bit.

U.S. Pat. No. 5,128,901, on the other hand, is concerned with suppressing echoes in the drill string resulting from previously transmitted acoustic waves.

U.S. Pat. No. 4,066,995 discloses isolation subs which serve to attenuate vibrations in the drill string caused by operation of the drill bit and rotation of the rotating table on the drill platform. The isolation subs dissipate low-frequency vibration energy so that vibrational resonances can be prevented.

SUMMARY OF THE INVENTION

It is an object of the present invention to provide improved noise reduction for drillstring torsional acoustic wave telemetry systems, and in particular to reduce surface-generated noise.

The present invention is at least partly based on the recognition that the ability of a reflector to attenuate torsional acoustic noise increases with the fourth power of the transverse dimension of the reflector. This is a much stronger dependence than for axial waves. Thus we have found that a simple acoustic reflector mounted to the surface end of a drill string, e.g. above an acoustic receiver, can be effective at reducing the amount of surface-generated torsional acoustic noise that enters the drill string. In this way, improved signal-to-noise ratios and improved data transmission rates along the drill string can be achieved.

In general terms the present invention provides an acoustic reflector which is mountable to the surface end of a drill string thereby suppressing the amount of surface-generated acoustic noise (such as is generated for example by a top drive), and particularly torsional acoustic noise, which enters the drill string.

A first aspect of the present invention provides a drill string telemetry system in which an acoustic reflector is mounted to the surface end of the drill string, the reflector being adapted to reflect surface-generated torsional acoustic noise away from the drill string, whereby the reflector attenuates the power of 500 Hz torsional acoustic noise impinging on the reflector by a factor of at least 100 (preferably at least 200, more preferably at least 1000, and even more preferably at 10000).

Although the attenuation behaviour of the reflector is defined above in relation to 500 Hz torsional acoustic noise, it is to be understood that the system may be operated using torsional acoustic signals at any suitable frequency or range of frequencies e.g. in the base, first or second pass band.

As well as reflecting acoustic noise away from the drill string, we have found that the reflector can increase the strength of acoustic signals transmitted along the drill string. Also, the reflector, functioning in effect as a flywheel at low frequencies, tends to smooth out variations in the driving mechanism of the drill string and thus reduces vibrations at source. Furthermore, if, as part of the telemetry system, an acoustic receiver which operates by detecting strains in the drill pipe is mounted below the reflector, the reflector advantageously increases these strains at the receiver.

Thus a useful figure of merit is the gain in signal-to-noise ratio (as measured by an acoustic receiver mounted to the surface end of the drill string below the reflector) produced by the installation of the reflector to a particular drill string. This takes into account the alteration of both signal and noise by the reflector.

Coupling subs and drill pipes typically have transverse diameters of up to about 15 cm. Thus the transverse outer dimension of the reflector relative to the direction of the drill string may be at least 30 cm (preferably at least 45 cm and more preferably at least 60 cm) so that the polar moment of the reflector is significantly larger than the polar moment of the components to which it is attached. This provides the reflector with a large reflection coefficient for impinging torsional acoustic waves, leading to improvements in signal-to-noise ratios. Clearly, for a cylindrical reflector the outer dimension is the outer diameter. This discussion refers to steel reflectors. In general, the important factor is the product; the density of the material times the speed of sound in the material times polar moment of the reflector. In what follows, we will assume that steel is used for the reflector, although other materials are contemplated.

A further aspect of the present invention provides a drill string telemetry system in which an acoustic reflector is mounted to the surface end of the drill string, the reflector being adapted to reflect surface-generated torsional acoustic noise away from the drill string, and the transverse outer dimension of the reflector relative to the direction of the drill string being at least 30 cm (preferably at least 45 cm and more preferably at least 60 cm).

The telemetry system typically further comprises an acoustic transmitter and an acoustic receiver for respectively transmitting and receiving torsional acoustic signals along a drill string to which the transmitter and receiver are acoustically coupled. One of the transmitter and the receiver (typically the receiver) may be coupled to the surface end of the drill string below the reflector. The other of the transmitter and the receiver may be coupled to the bottom hole end of the drill string, e.g. above the bottom hole assembly (BHA). Typically an acoustic baffle is mounted between the BHA and the transmitter/receiver.

We have found that by mounting the reflector to the drill string it should be possible to achieve signal bit rates between the transmitter and receiver of 10 bits/sec and higher for a range of typical drill string operating conditions.

In a preferred embodiment the reflector is a substantially cylindrical body formed e.g. of steel and mounted coaxially to the end of the drill string.

The reflector may comprise one or more dismountable masses, whereby the degree of attenuation of surface-generated noise impinging in the reflector may be selected by varying the number of masses mounted to the drill string. Thus the physical properties of the reflector can be adapted depending on the circumstances of the drill string and the telemetry requirements.

The primary source of surface-generated noise is usually the top drive. Thus in one embodiment of the present invention the reflector is mounted below the top drive, whereby acoustic noise generated by the top drive can be reflected away from the drill string.

In such an embodiment, the reflector is also believed to reduce the amount of acoustic noise entering the drill string by reducing the amplitude of backlash, which is thought to be the main reason for top drive torsional noise. We believe this is because the reflector acts like a flywheel.

A further aspect of the present invention provides an acoustic reflector for use in the telemetry system of any of the previous aspects. Thus preferably the reflector is adapted for connection below a top drive.

A further aspect of the present invention provides a method of shielding a torsional acoustic wave drill string telemetry system from acoustic noise, the method comprising:

selecting a predetermined telemetry signal bit rate or predetermined gain in signal-to-noise ratio, and mounting an acoustic reflector to the surface end of the drill string (e.g. below a top drive of the drill string) so that surface-generated torsional acoustic noise is reflected away from the drill string and the predetermined signal bit rate or predetermined gain in signal-to-noise ratio is achieved.

The predetermined signal bit rate may be at least 2 bits per sec, but more preferably is at least 10 or 20 bits per sec.

The predetermined gain in signal-to-noise ratio may be at least 100, but more preferably is at least 200, 1000, or 10000.

Preferably the acoustic reflector attenuates the power of 500 Hz torsional acoustic noise power impinging on the reflector by a factor of at least 100 (more preferably at least 200, 1000, or 10000).

Preferably the transverse outer dimension of the reflector relative to the direction of the drill string is at least 30 cm (more preferably at least 45 or 60 cm).

The reflector may have any of the optional features of the reflectors of the previous aspects.

BRIEF DESCRIPTION OF THE DRAWINGS

Specific embodiments of the present invention will now be described with reference to the following drawings in which.

DETAILED DESCRIPTION

Figure 1:
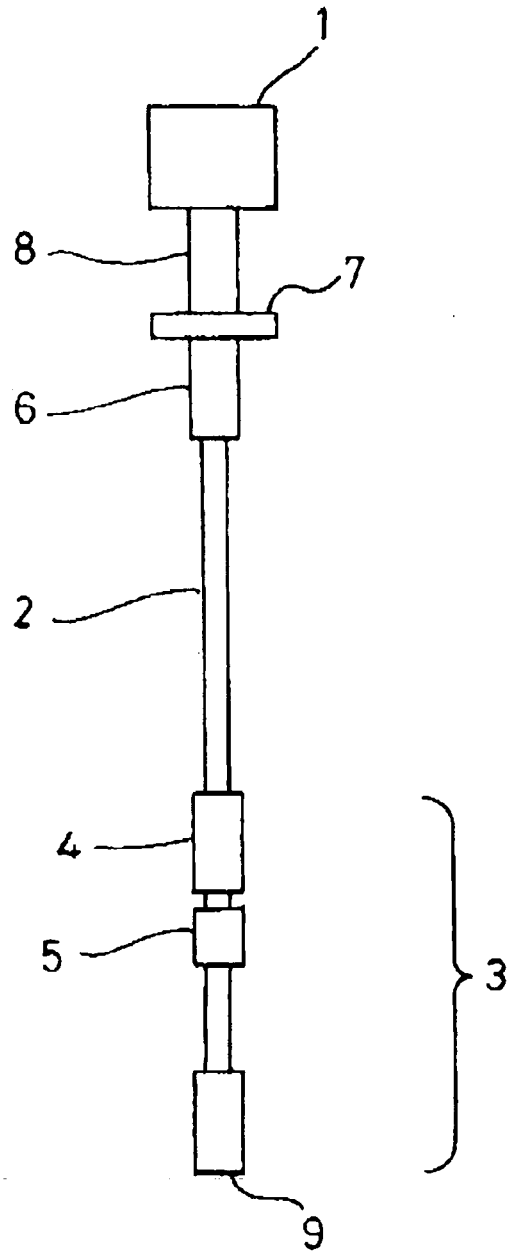
FIG. 1 shows a schematic a drawing of a telemetry system according to the present invention.

FIG. 1 shows a schematic a drawing of a telemetry system according to the present invention.

A surface top drive 1 rotates a drill string 2 and a bottom hole assembly (BHA) 3. A downhole torsional wave actuator (i.e. an acoustic transmitter) 4 is mounted on the drill string near the upper end of the BHA and is acoustically isolated from the rest of the BHA by a baffle 5. At the lower end of the BHA is drill bit 9. Torsional acoustic wave signals propagate up the drill string to be detected at the surface by a measurement sub (i.e. an acoustic receiver) 6.

Above the measurement sub, a steel reflector 7 terminates the drill string and is connected to the top drive via a linking sub 8. The reflector reflects much of the acoustic noise generated by the top drive and propagated through the linking sub away from the drill string, so that only a relatively small proportion of surface-generated noise enters the drill string. The reflector is able to do this because it has a significantly greater diameter than the linking sub.

Thus the relatively simple expedient of installing the reflector above the measurement sub significantly improves the signal-to-noise ratio at the measurement sub, which allows higher data transmission rates to be achieved between the actuator and the measurement sub.

Although the basic operation of the reflector is simple to understand, quantifiably predicting the improvements in signal-to-noise ratio and data transmission rates that can be expected for the particular circumstances of a given drill string is significantly more complicated. The following analysis shows how such predictions may be made. However, in practice a drill operator may install the appropriate reflector to provide e.g. a target signal bit rate or gain in signal-to-noise ratio. He may, for example, increase the diameter of the reflector until the target is achieved.

Torsional Wave Propagation in Drill Strings

Torsional acoustic waves are simply oscillations of torsion or twist.

For a highly symmetric and essentially one dimensional object such as a drill string the propagation of torsional waves along the string may be described by the wave equation:

$$\frac{\partial^2 \varphi}{\partial z^2} = \frac{1}{c^2}\frac{\partial^2 \varphi}{\partial t^2}$$

where $\phi$ is the angular displacement at time t and axial distance z. Solutions of this equation for drill strings are discussed below and have also been described in U.S. Pat. No. 5,128,901 and in the paper by Drumheller and Knudsen referenced above.

These solutions allow a simplified model of the drill string to be constructed wherein the torques anywhere in the drill string can be calculated when a driving torque is applied at a specified point (usually at the ends of the drill string). As will be shown below, such calculations allow an estimate to made of the expected signal-to-noise gain when a reflector is introduced below the top drive.

The wave speed is given by:

$$c = \sqrt{\frac{S}{\rho}}$$

where S is the shear modulus and $\rho$ is the density. For steel, c is about 3000 $ms^{-1}$. An important derived quantity is the impedance, $\rho c$.

If a drillstring is excited by a steady periodic displacement or torque, we expect to find solutions for the wave equation which are standing waves. In fact, a solution is:

$$\phi(z,t)=e^{i\omega t}(ae^{-ikz}+be^{ikz})$$

where k is the wavenumber which is related to the angular frequency $\omega$ by $kc=\omega$.

To determine a and b we apply boundary conditions. For a simple object we might have the harmonic driver (say of unit amplitude) located at z=0 giving one boundary condition of a+b=1, and say a zero displacement condition at z=L. Another possibility is a boundary condition on torque. For a cylindrical object of radius, r, it can be shown that the torque, $\tau$, at any point is given by:

$$\tau = \frac{\pi r^4 S}{2}\frac{\partial \varphi}{\partial z}$$

The quantity $$\frac{\pi r^4}{2}$$

is called the polar moment, and in general depends on the fourth power of the typical radial dimension of an object. Multiplying the polar moment of a homogeneous cylinder by its height and weight gives its moment of inertia.

A drill string consists of a variety of cylindrical elements (e.g. drill pipes, connectors etc.) which are screwed together. In this case, we expect the full standing wave solution to involve determining $a_i$ and $b_i$ in each element i of the string. Each element will be characterised by its shear modulus, density and polar moment. The complete solution for the drillstring entails matching the individual standing waves at the joins between elements, where the joining conditions are simply continuity of displacement $\phi$ and torque $\tau$.

Because of the spatial derivative and the appearance of the polar moment, continuity of torque will introduce both the impedance and the polar moment into the equations determining the amplitudes. A discontinuity in impedance or polar moment will result in a reflection.

In addition two boundary conditions are needed at the ends of the drillstring where the drillstring is coupled to other objects. Various approaches are possible but the present analysis uses a radiative boundary condition at each end. This means matching the standing waves to outgoing waves which are presumed to propagate respectively into the top drive and the bottom hole rock without returning. At both the top drive and the bit-rock interface, torques are applied to the drillstring. Therefore the boundary condition is to require a discontinuity in $$\frac{\partial \varphi}{\partial z}$$

which matches the applied torque. The present analysis assumes equal torque amplitudes at all frequencies, in other words an impulsive torque loading. The steady torque and rotation of the drillstring does not need to be modelled.

Each end of the drillstring is therefore characterised in this model by an impedance of the terminating object (i.e. the top drive or bottom hole rock) and an applied torque. To achieve a detailed solution for the complete set of $a_i$ and $b_i$ requires a numerical solution, involving the solution of sparse sets of linear equations. For a drillstring containing N elements, the boundary and joining conditions will give 2N+2 equations for 2N+2 amplitudes.

Because drillstrings have many distinct elements, a large number of which are periodically arranged, the temporal power spectrum at position z, namely $$|ae^{-ikz}+be^{ikz}|^2,$$

has a rich structure.

Firstly, any significant length of drillstring has a high number of resonances. For example, if the ends are nearly fixed then there will be a resonance when any half integral number of waves can be fitted into the length of the string. For even a short drillstring, say 1000 m, the low frequency resonances will be spaced by less than a Hertz. In fact the true situation is much more complicated than this, because there will be reflections at every change in cross-section (where the polar moment changes). Appropriate fractions of a wavelength can be fitted in between these changes and this gives rise to yet more resonances.

Secondly, however, there are gross features in the spectrum. These arise from the periodic structure of the drillstring. Thus the drillstring has well defined pass and stop bands.

Finally, it should be noted that the waves on a drillstring are damped or attenuated to some extent. This strictly rules out the standing wave solutions, which are time invariant.

However, a reasonable approach is to assume a weakly complex value for the wavenumber k.

Figure 2:
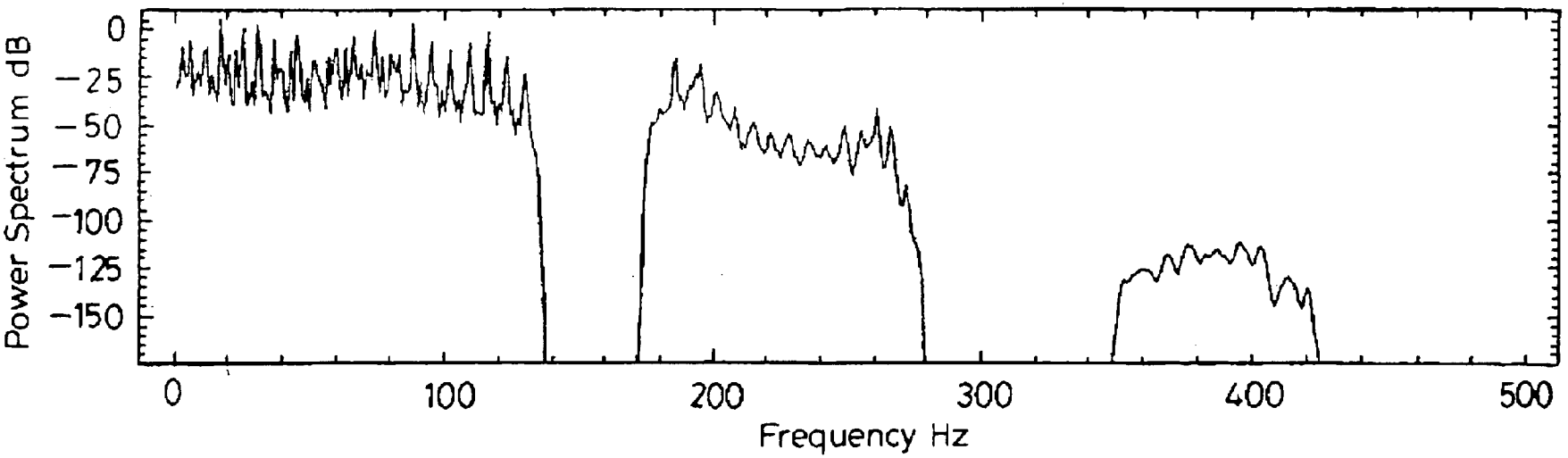
FIG. 2 shows the predicted torque power spectrum of a typical short drill string, about 2500 feet (770 m) in length, excited by an impulse at the drill bit and measured near the surface.

FIG. 2 shows the predicted spectra of a short drillstring, about 770 m (2500 feet) in length. The spectra are shown for the case of excitation at the bit and measurement at the surface. The rich resonance spectrum, and the pass and stop bands, are apparent.

Figure 3:
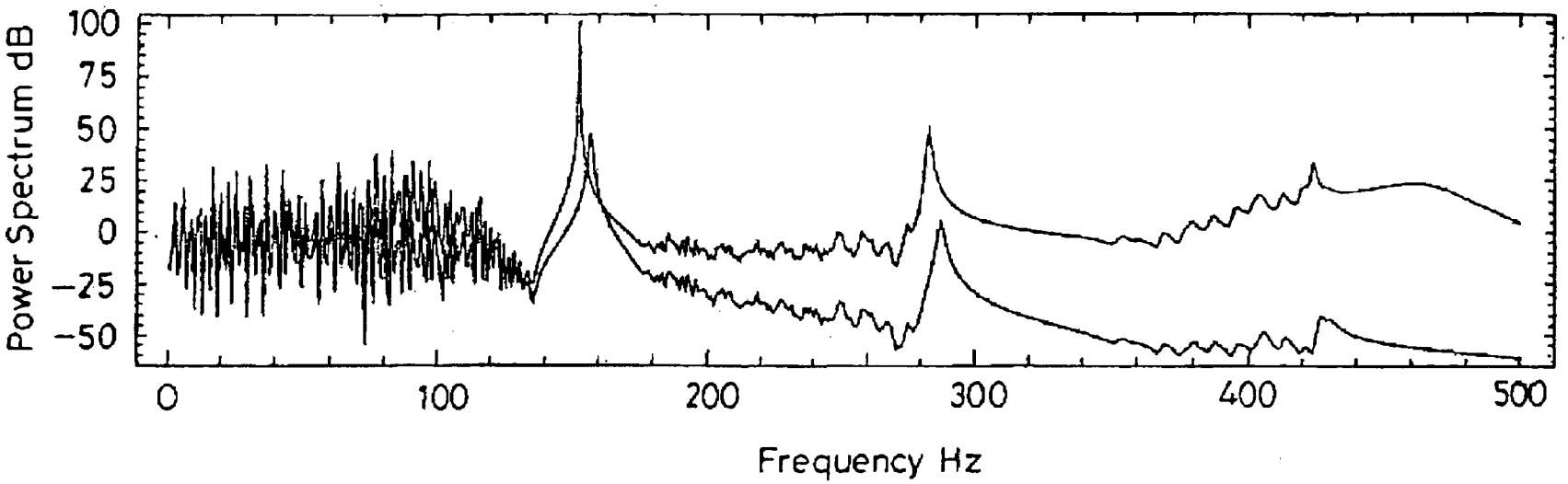
FIG. 3 shows the torque power spectra for the drill string as depicted in FIG. 2 excited by an impulse at the top drive, and measured just below the top drive.

FIG. 3 shows the torque power spectra for the drill string as depicted in FIG. 2 excited by an impulse at the top drive, and measured just below the top drive. Such impulses would be noise. The upper curve has no reflector and the lower curve has a steel cylindrical reflector, of 12 inches (300 mm) diameter and 3 feet (910 mm) length, interposed between the top drive and the receiver.

Signal and Noise

Denoting the available bandwidth by B, the signal by S and the noise by N, the limiting channel capacity (or the ability of a drillstring to carry information) is given in Shannon's well-known formula:

$$C = B\log_2\left(1 + \frac{S}{N}\right),$$

where C is in bits $s^{-1}$. The signal-to-noise ratio (SNR), $$\frac{S}{N},$$

which appears in this equation is the ratio of signal S and noise N powers.

Practical implementations of torsional telemetry generally have to deal with noise generated at the bit and at the surface. However, GB-A-2327957 describes a downhole noise isolating section that is effective in isolating the receiver from bit noise.

In what follows, therefore we only consider the effects of noise impinging on a drill string at the surface. More specifically, we consider the arrangement shown in FIG. 1 in which noise is generated by the top drive, and the reflector is interposed between the surface receiver and the top drive.

The capacity, or bit rate, is an important characteristic of a telemetry system. To analyze this we include more detail in Shannon's capacity equation.

It is well known that the acoustic signal will be attenuated as a function of the distance from the transmitter. The signal S at distance L will be:

$$S_0 e^{-\alpha L},$$

where $S_0$ is the strength of the signal at the transmitter and $\alpha$ is the attenuation coefficient.

In our case, therefore, the capacity equation is:

$$C_0 = B\log_2\left(1 + \frac{S_0 e^{-\alpha L}}{N}\right)$$

with no reflector, and $$C_1 = B\log_2\left(1 + \frac{\beta S_0 e^{-\alpha L}}{N}\right)$$

when a reflector is mounted to the end of the drill string, $\beta$ being the gain or enhancement in signal-to-noise ratio associated with the use of the reflector.

A convenient way of characterizing the effectiveness of the reflector is to calculate the increased depth that can be attained at a predetermined channel capacity. Denoting the attained depth without the reflector as $L_0$, and with the reflector as $L_1$, it follows from these equations that:

$$L_1 - L_0 = \frac{\ln\beta}{\alpha}.$$

For typical values of $\alpha$ in drilling mud of around 0.7 $kft^{-1}$ (2.3 $km^{-1}$) we see that a value of $\beta$ as low as 2 will allow an extra 1000 feet (300 m) of drilling. At shallow depths, therefore, the reflector should permit a large percentage increase in attainable depth. At greater depths the percentage increase will be smaller, but the installation of the reflector should permit communication over at least an extra few thousand feet, which may well include vital reservoir sections. In foam and other gasified muds $\alpha$ will be much smaller and the ability of the reflector to extend the attainable depth will be correspondingly greater.

Alternatively we can estimate how much the bit rate can be increased at a fixed depth. For large signal-to-noise ratios, it follows from the above equations that:

$$C_1 - C_0 = B\log_2\beta.$$

Thus, for $\beta=2$ the bit rate can be increased by B bits/sec. For the second pass band, the available bandwidth B is about 100 Hz, so this is a substantial effect.

As shown above, the transfer function for the drillstring channel is complicated. Assuming information is equally likely to be carried at any frequency in the bandpass (so the signal has a flat spectrum in this frequency range) then the signal power is:

$$S = \int_B |a e^{-ikz} + b e^{ikz}|^2 dk$$

for a unit impulse applied near the bit, where the integration is over the available pass band. Likewise the noise power can be derived from a similar integral over the bandpass, except for a's and b's derived for a unit impulse at the surface.

Known baffles (such as that described in GB-A-2327957) are effective at isolating the bit from the drillstring at the frequencies of interest in the first pass band. In respect of noise generated at the surface, and in particular, by the top drive, we have found that isolation can be achieved by mounting below the noise source a mass which has a considerably larger impedance×polar moment product, than the adjacent pipes. In simple terms, this introduces a large reflection coefficient which prevents downgoing noise generated by the noise source, from reaching measurement devices such as acoustic receivers mounted below the mass.

However, in detail the physics of the reflection is not quite so simple—for example, the high reflection coefficient traps energy above the reflector so the standing waves there may build up to large amplitudes. In addition, the reflector affects the amplitude of the signal, in effect because the boundary condition has been altered (the drillstring appears to end at the reflector, as far as vibrations below it are concerned). The detail of the boundary conditions is also relevant, as this determines the leakage of energy out of the drill string and top drive.

There are two consequences of this complicated physical situation. Firstly, it is usually necessary to model a complete drillstring to see the effect of including a reflector. Secondly, it is simplest to calculate a relative change in SNR. Thus, the SNR is calculated for the drillstring without the reflector, then the reflector is introduced and the SNR calculated again. The ratio of the two SNR's provides an estimate of β, the gain in SNR. This indicates the effectiveness of the reflector.

Modelling Results

Figure 4:
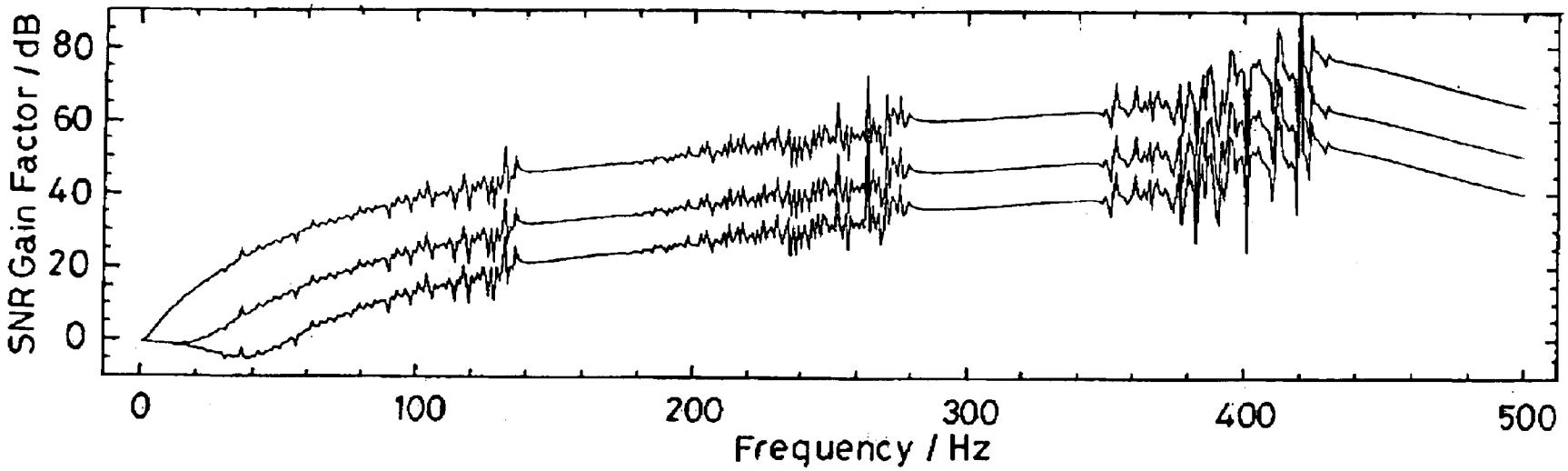
FIG. 4 shows the gain in signal-to-noise ratio in torque, as function of frequency and reflector diameters.

FIG. 4 demonstrates the effect of including a reflector on the drill string of FIG. 2. FIG. 4 shows the signal-to-noise ratio gain factor as a function of frequency, for three cases. This gain is plotted as a function of frequency, for the same drill string and reflector as before, varying its diameter from 12 inches (300 mm) (bottom curve) through 18 inches (450 mm) to 24 inches (600 mm) (top curve). The predicted gains in signal-to-noise in general rise with frequency and can be very large.

Figure 5:
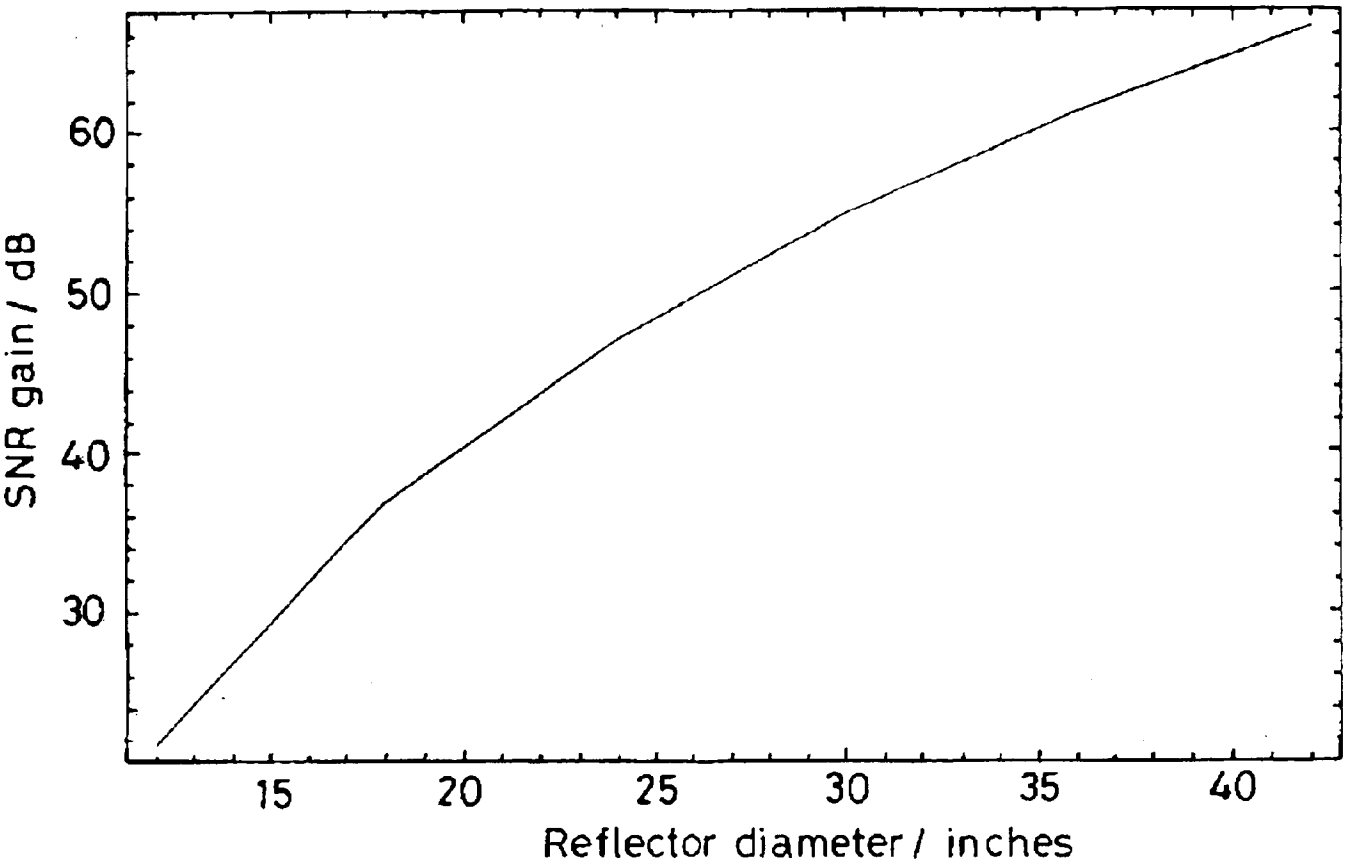
FIG. 5 shows the gain in signal-to-noise ratio, averaged over the first pass band, as a function of reflective diameter.

FIG. 5 demonstrates the dependence on reflector diameter when considering the average gain over the whole of the first pass band.

Various other models have been considered, including varying the top end boundary condition, the length and diameter of the reflector, and the length of the drill string. Essentially because of the strong $r^4$ dependence of the polar moment of a cylinder, it was always possible to obtain very large gains in SNR for manageable sizes of reflector, i.e. less than 36 inches (914 mm) diameter.

The general effect of the reflector is to act as a low-pass filter. At low frequencies, there is time for the large moment of inertia of the reflector to respond to oscillations and so it is transparent. At higher frequencies the reflector does not have time to move and so it is opaque.

Another, complex effect, which is thought to be helpful, is that the reflector reduces the amplitude of backlash, which is believed to be the main reason for top-drive torsional noise.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. A drill string telemetry system comprising an acoustic reflector mounted to the surface end of the drill string during drilling, the reflector being adapted to reflect surface-generated torsional acoustic noise away from the drill string, whereby the reflector attenuates the power of 500 Hz torsional acoustic noise power impinging on the reflector by a factor of at least 100.

2. A drill string telemetry system according to claim 1, wherein the reflector attenuates the power of 500 Hz torsional acoustic noise power impinging on the reflector by a factor of at least 200.

3. A drill string telemetry system according to claim 2, wherein the reflector attenuates the power of 500 Hz torsional acoustic noise impinging on the reflector by a factor of at least 1000.

4. A drill string telemetry system according to claim 3, wherein the reflector attenuates the power of 500 Hz torsional acoustic noise impinging on the reflector by a factor of at least 10000.

5. A drill string telemetry system according to claim 1, wherein the transverse outer dimension of the reflector relative to the direction of the drill string is at least 30 cm.

6. A drill string telemetry system according to claim 5, wherein the transverse outer dimension of the reflector relative to the direction of the drill string is at least 45 cm.

7. A drill string telemetry system according to claim 6, wherein the transverse outer dimension of the reflector relative to the direction of the drill string is at least 60 cm.

8. A drill string telemetry system comprising an acoustic reflector mounted to the surface end of the drill string, the reflector being adapted to reflect surface-generated torsional acoustic noise away from the drill string, and the outer dimension of the reflector measured transversely to the direction of the drill string being at least 30 cm.

9. A drill string telemetry system according to claim 8, wherein the transverse outer dimension of the reflector relative to the direction of the drill string is at least 45 cm.

10. A drill string telemetry system according to claim 8, wherein the transverse outer dimension of the reflector relative to the direction of the drill string is at least 60 cm.

11. A drill string telemetry system according to claim 8, wherein the reflector is mounted below the drill string top drive so that the reflector reflects acoustic noise generated by the top drive away from the drill string.

12. A drill string telemetry system according to claim 8, wherein the reflector is adapted to reflect primarily torsional acoustic waves away from the drill string.

13. A drill string telemetry system according to claim 8, wherein the reflector comprises a substantially cylindrical body mounted coaxially with the drill string.

14. A drill string telemetry system according to claim 8, wherein the reflector is formed of steel.

15. A drill string telemetry system according to claim 8, wherein the reflector comprises one or more dismountable masses so that the degree of attenuation provided by the reflector may be selected by varying the number of masses mounted to the drill string.

16. An acoustic reflector according to claim 8, wherein the reflector is adapted for connection below a top drive.

17. A method of shielding a torsional acoustic wave drill string telemetry system from acoustic noise, the method comprising:

selecting a predetermined telemetry signal bit rate, and mounting an acoustic reflector to the surface end of the drill string so that surface-generated torsional acoustic noise is reflected away from the drill string and the predetermined signal bit rate is achieved.

18. A method of shielding a torsional acoustic wave drill string telemetry system from acoustic noise, the method comprising:

selecting a predetermined gain in signal-to-noise ratio, and mounting an acoustic reflector to the surface end of the drill string so that surface-generated torsional acoustic noise is reflected away from the drill string and the predetermined gain in signal-to-noise ratio is achieved.

* * * * *